US006847589B2

(12) United States Patent
Wilmouth

(10) Patent No.: US 6,847,589 B2
(45) Date of Patent: Jan. 25, 2005

(54) WATCH INCLUDING A CASE OF ELONGATED SHAPE

(75) Inventor: Jean Wilmouth, Bois d'Amont (FR)

(73) Assignee: Nouvelle Lemania SA, Orient (CH)

( * ) Notice: Subject to any disclaimer, the term of this patent is extended or adjusted under 35 U.S.C. 154(b) by 0 days.

(21) Appl. No.: 10/401,531

(22) Filed: Mar. 31, 2003

(65) Prior Publication Data

US 2003/0189875 A1 Oct. 9, 2003

(30) Foreign Application Priority Data

Apr. 3, 2002 (CH) ..... 0563/02

(51) Int. Cl.[7] ..... G04B 19/26
(52) U.S. Cl. ..... 368/17; 368/16
(58) Field of Search ..... 368/15–17, 203–204

(56) References Cited

U.S. PATENT DOCUMENTS

| | | | | | |
|---|---|---|---|---|---|
| 1,459,710 | A | * | 6/1923 | Balch | 368/17 |
| 2,224,268 | A | * | 12/1940 | McDonald | 368/17 |
| 4,674,889 | A | * | 6/1987 | Klaus | 368/28 |
| 4,684,260 | A | * | 8/1987 | Jackle | 368/16 |
| 4,759,002 | A | * | 7/1988 | Cash | 368/15 |
| 4,766,579 | A | * | 8/1988 | Sporring | 368/190 |
| 5,023,849 | A | * | 6/1991 | Vaucher | 368/15 |
| 5,065,373 | A | * | 11/1991 | Alcantara Maia | 368/278 |
| 5,943,302 | A | * | 8/1999 | Fanshaw | 368/276 |
| 6,359,839 | B1 | * | 3/2002 | Schenk et al. | 368/16 |

FOREIGN PATENT DOCUMENTS

| | | | | |
|---|---|---|---|---|
| CH | 183 000 | | 3/1936 | |
| CH | 218 931 | | 1/1942 | |
| CH | 313 609 | | 4/1956 | |
| CH | 366610 | A1 * | 10/1989 | 368/15 |
| JP | 63128284 | * | 5/1988 | 368/15 |

OTHER PUBLICATIONS

"Announcement", Uhren Juwelen Schmuck, Bielefelder Verlagsanstalk K.G., Bielefeld, DE, No. 4, Apr. 1, 1995, p. 72 XP000517569.

* cited by examiner

*Primary Examiner*—Kamand Cuneo
*Assistant Examiner*—Thanh S. Phan
(74) *Attorney, Agent, or Firm*—Sughrue Mion, PLLC

(57) ABSTRACT

The watch disclosed has a case of ovoidal shape, wherein a circular watch movement (5) is arranged off-center, on the side of the end of the case with the larger radius. On the side of the other end there is a moon phase indicator disc (16) and a power-reserve indicator of the watch. The moon disc is driven step-by-step by the movement (5) via a control lever (35) having a beak (43) that drives an external toothing (44) of the disc. This lever extends at least partly along one edge of the case, where a correction push-button is mounted, that can activate (P) the lever in the same direction as the movement is driving, which prevents any interference between the two actions.

11 Claims, 4 Drawing Sheets

WATCH INCLUDING A CASE OF ELONGATED SHAPE

TECHNICAL FIELD

The present invention concerns a watch having a case of elongated shape containing an elongated dial, a watch movement, time indicating members associated with an hour-circle on the dial, an additional indicator arranged outside said hour-circle in proximity to one end of the dial, and means for correcting the additional indicator, the additional indicator comprising a toothed disc driven step-by-step by a control lever periodically actuated by the watch movement via a cam mechanism.

BACKGROUND ART

In wristwatches of elongated shape, using this shape to juxtapose a conventional hour-circle on the dial, in front of which an hour hand and minute hand rotate, and an additional indicator that may for example be a small seconds, a chronograph, date, moon phase indicator, etc., is already known. For example, CH Patent No. 167 847 discloses a wristwatch of this type, wherein a conventional watch movement is completed by an additional plate carrying the gear trains necessary for displaying off-centre, on the one hand, the hour and the minute, and on the other hand the second by a so-called small seconds hand. The watch movement provided in this case has an elongated shape and its output axis is at the centre of the watch.

In CH Patent No. 218 931, a timepiece is disclosed in the form of a ship's chronometer which comprises two sets of hands for indicating respectively civil time and sidereal time on two similar dials, juxtaposed in a rectangular case. A common clockwork movement directly drives the civil time display. The sidereal time display is driven from the seconds wheel of the movement, via a cascade of five intermediate wheel sets distributed in the length of the case and ensuring the proper fixed transmission ratio. Such a construction cannot be used in a watch, because of its size and the juxtaposition of two relatively large hour-circles.

In the present invention, it is sought to take advantage of the elongated shape of the case, not only to juxtapose different indicators in the direction of the largest dimension of the case and the dial, but also to distribute the mechanisms driving these indicators in the case in an advantageous manner.

In particular, in the case of an additional indicator driven step-by-step, as is the case of a day of the month indicator or a moon phase indicator, a particular problem lies in the embodiment of correction means allowing a user to correct the additional indicator without interfering with the stepping drive mechanism, which connects it to the watch movement. A conventional solution consists in incorporating a ratchet system in this drive mechanism in order to avoid damaging the mechanism when it is meshed at the moment that a correction is made. The drawback of this solution is that it requires additional elements which complicate the construction. Another solution consists in driving the additional indicator from the watch movement by means of a lever pivoting on which the correction means act by causing the lever to pivot in the same direction as the driving, which prevents one interfering with the other. CH Patent No. 519 191 discloses a construction of this type, wherein a control lever for the date indicator pivots about the centre of the watch movement, the correction means being formed by the usual control stem of the watch, which can operate as a push-button and act on the lever via an additional lever. However, this construction has a substantial drawback because the lever is of large size and covers a large part of the watch movement surface. Further, the arrangement of the control stem in the form of a stem having a push-piece function represents an extra complication.

SUMMARY OF THE INVENTION

It is an object of the present invention to avoid the aforecited drawbacks, owing to an advantageous arrangement of the additional indicator and its drive and correction means in a watchcase of elongated shape. An additional object consists in providing the watch with a case whose shape aesthetically matches the arrangement of the various indicators.

Thus, there is provided a watch of the type indicated in the preamble, characterised in that said toothing of the additional indicator disc is an external toothing driven by a beak of the control lever, in that the control lever comprises a first arm, which co-operates with the watch movement, a second arm provided with said beak, and a pivoting axis situated between the first and second arm, in that at least the second arm of the control lever extends substantially along an edge of the case and in that the correction means comprise a push-button arranged in said edge of the case and arranged to cause the control lever to pivot by pressing on its second arm.

Thus, the second arm of the control lever can advantageously extend between the additional indicator disc and said edge of the case where the correction push-button is located. This push-button can act directly by pressing on an element of this lever arm, which simplifies construction and tends to momentarily uncouple the cam drive mechanism, without applying any damaging effort thereto. Correction can therefore be made at any moment.

In a particularly advantageous embodiment, the case and the dial have an ovoidal shape, and the watch movement has a substantially circular shape and is housed in the end of the ovoidal case with the largest radius.

According to another aspect of the invention, there is provided a watch having a case of elongated shape containing an elongated dial, a watch movement, time indicating members associated with an hour-circle on the dial, an additional indicator arranged outside said hour-circle in proximity to one end of the dial and driven by the watch movement via a control mechanism, and wherein the case and the dial have an ovoidal shape, having one end of larger radius and one end of smaller radius, the watch movement is substantially circular and arranged in an off-centre position in the direction of the end of larger radius, the additional indicator being-arranged in proximity to the other end of the case, and the additional indicator control mechanism comprises a control lever extending in proximity to one edge of the case.

BRIEF DESCRIPTION OF THE DRAWINGS

Other features and advantages of the invention will appear in the following description of a preferred embodiment of a wristwatch of substantially oval shape, given by way of non-limiting example with reference to the annexed drawings, in which.

DESCRIPTION OF PREFERRED EMBODIMENTS

Figure 1:
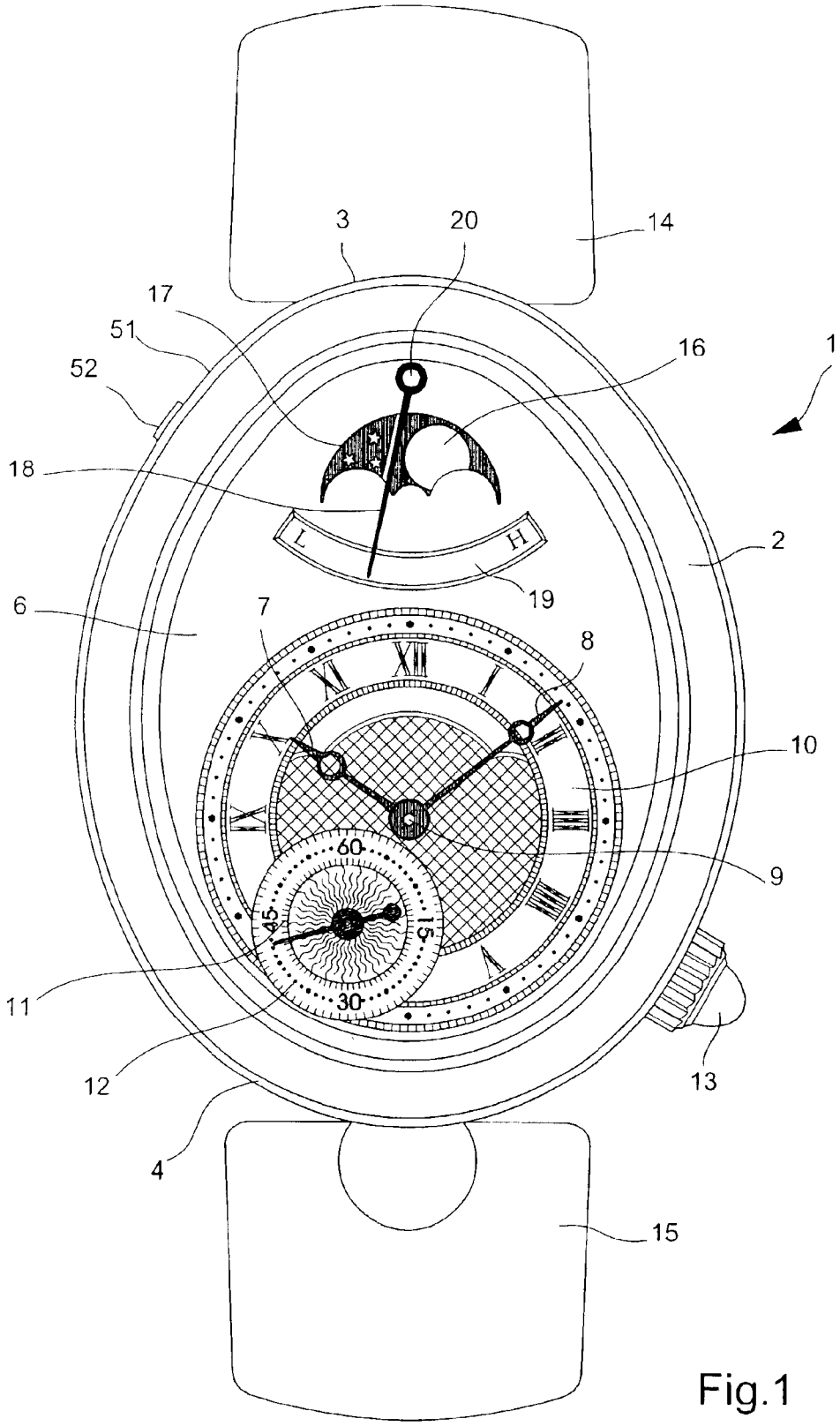
FIG. 1 is a plan view of the top face of the watch, including conventional time indicating members, a moon phase indicator and a power-reserve indicator.
Figure 2:
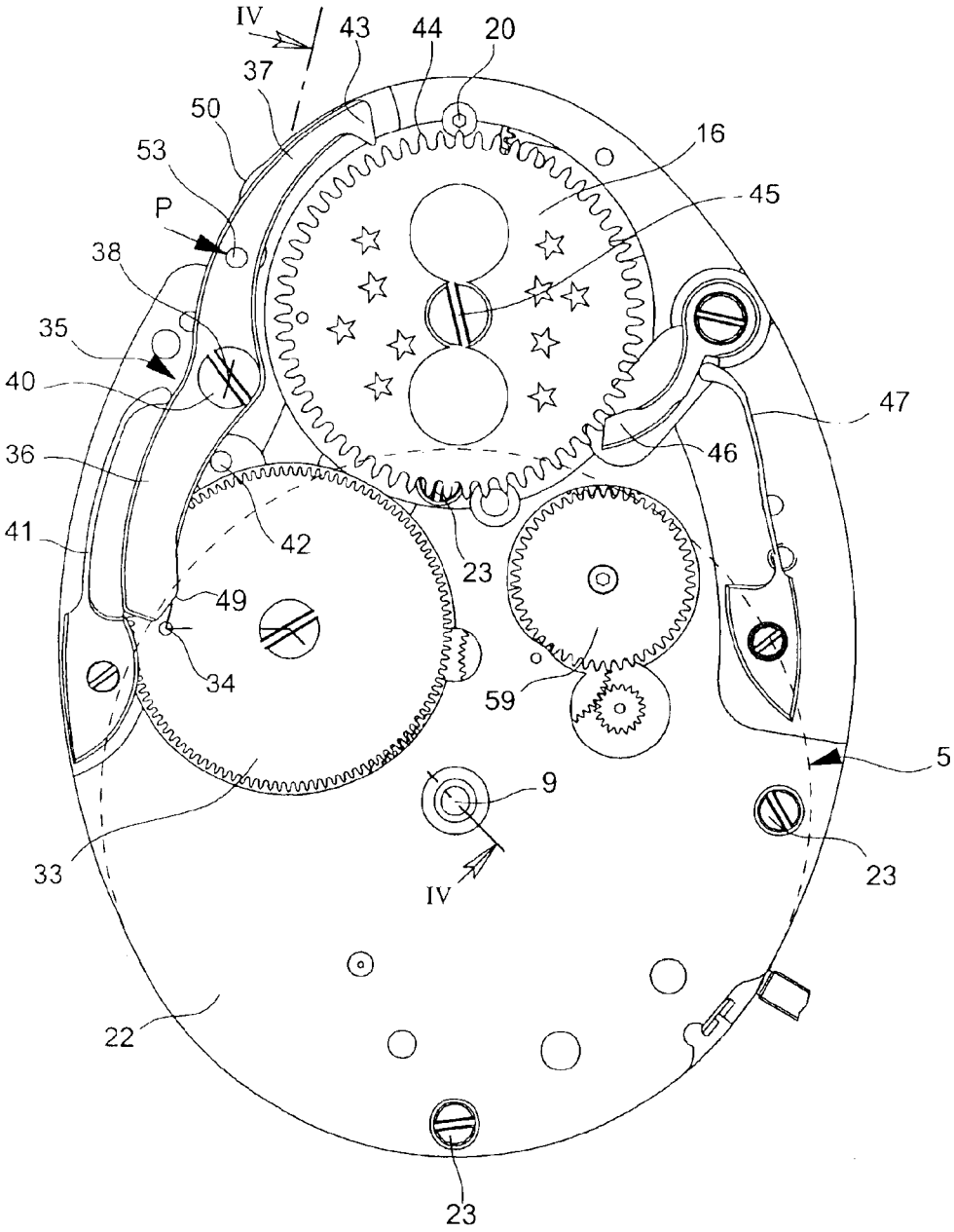
FIG. 2 shows the drive mechanism for the moon phase indicator.
Figure 3:
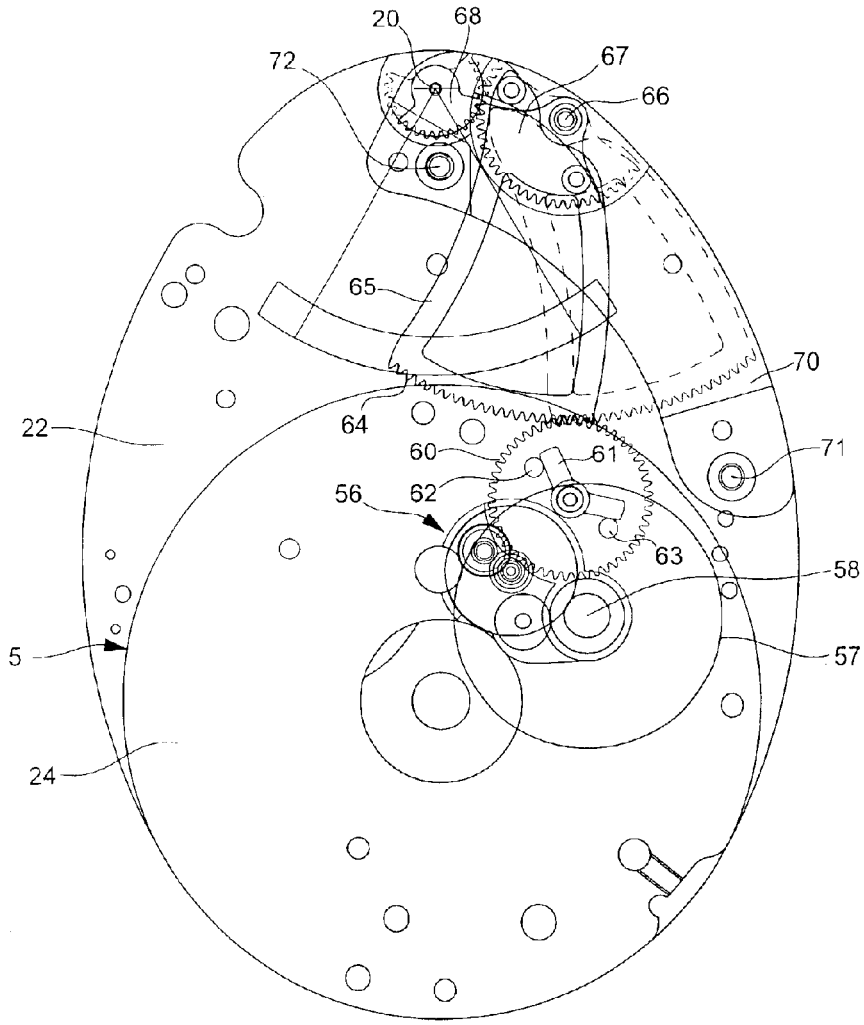
FIG. 3 shows the plate of the watch movement and the power-reserve indicator drive mechanism.

Watch 1 shown in the drawings has a case 2 of substantially oval shape, or more precisely ovoidal, the top end 3 of which has a smaller radius than the radius of bottom end 4, the radius of the latter being determined by the radius of a conventional circular watch movement 5 whose contour is shown in FIGS. 2 and 3. Dial 6 of the watch has a similar shape to that of case 2. In its lower part there are conventional time indicating members, comprising an hour hand 7 and a minute hand 8 which rotate around the centre 9 of movement 5 facing an hour-circle 10, and a small seconds hand 11, which is off-centre with respect to centre 9 and rotating facing a specific scale 12. Movement 5 is a common automatic watch movement, preferably of the Applicant's type 7866 NL. It is controlled in a conventional manner by means of a control stem directed radially with respect to the movement and provided with a control crown 13. Because of the ovoidal shape of the case, the control stem does not occupy the traditional "3 o'clock" position of hour-circle 10, but a position substantially at "4 o'clock", such that movement 5 is rotated through 30° with respect to its usual position and small seconds 11 is at "7 o'clock" on hour-circle 10. Thus the control stem intersects the case edge at right angles. The longitudinal axis of case 2 and dial 6 is parallel to the direction of the wristband, whose ends 14 and 15 are respectively attached to ends 3 and 4 of the case.

Two additional indicators are arranged on the side of top end 3 of the watch. They are a moon phase indicator, formed by a disc 16 appearing in an aperture 17 of dial 6, and a power-reserve indicator, formed by a hand 18 moving in a circular sector facing a scale 19 to indicate the tension in the spring of the barrel of movement 5, between a state L (low) and a state H (high). The shaft 20 of hand 18 is close to the top end of the dial. Thus, the two additional indicators are in the small end of the ovoidal shape, thus in a space which is not occupied by watch movement 5, nor by time indicating members 7 to 12.

Figure 4:
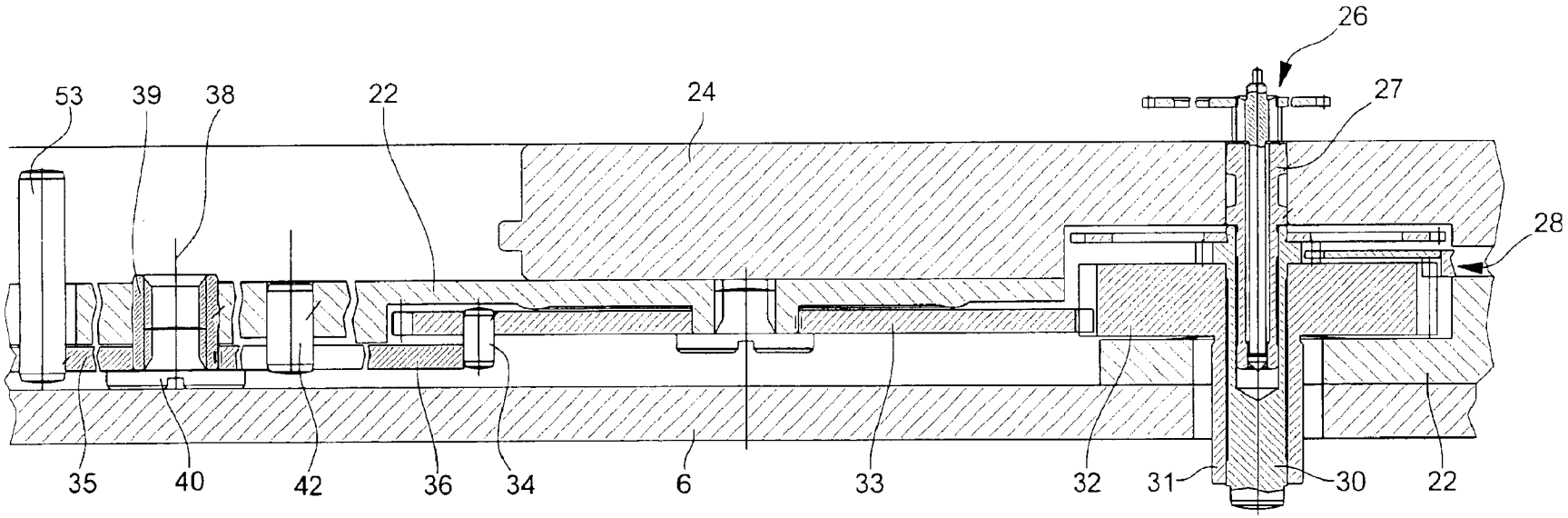
FIG. 4 is a cross-section along the line IV—IV of FIG. 2.

With reference to FIGS. 2 and 4, the elements of the moon phase indicator and its control mechanism will now be described. These elements are mounted on a plate of mechanism 22 which has an ovoidal shape adapted to that of case 2 and which his secured by screws 23 to circular plate 24 of watch movement 5. In a conventional manner, this movement includes a centre seconds wheel set 26 mounted in a pipe 27, a motion-work train 28, a blind cannon-pinion 30 carrying minute hand 8, and an hour wheel pipe 31 carrying hour hand 7 and secured to an hour wheel 32 which meshes with a control wheel 33 that makes one revolution in twenty four hours. Wheel 33 is mounted on a plate of mechanism 22 on the side of dial 6 and provided with a pin 34 for activating a control lever 35 once a day, which causes moon phase indicator disc 16 to move forward by one step.

Lever 35 is formed by a simple flat part forming a lever with two arms 36 and 37, between which pivot axis 38 is located, said axis having the form of a tube 39 fixed in plate 22 and in which a holding screw 40 is engaged. A spring 41 tends to hold lever 35 in a rest position, in which its first arm 36 rests against a stop mechanism 42, whereas a beak 43 arranged a the end of its second arm 37 is not engaged in an external toothing 44 with fifty nine teeth of moon phase disc 16. this disc is rotatably mounted on the plate of mechanism 22, about an axis 45 defined by a screw, and it is held in position by a jumper 46 stretched by a spring 47 to engage in toothing 44.

The end of first arm 36 of control lever 35 has a V-shaped cam surface 49 against which pin 34 of wheel 33 can slide pushing arm 36 outwards, such that lever 35 pivots clockwise about its axis 38 and its beak 43 is obliquely engaged in toothing 44 to cause disc 16 to move forward one step, until jumper 46 has cleared the next tooth. This operation is carried out once a day and as a result, disc 16 completes one revolution in fifty-nine days, i.e. approximately two lunations. It will be noted that, due to the V-shape of cam surface 49, the action of pin 34 is the same whatever the rotational direction of wheel 33. This means that no intermediate wheel is necessary between hour wheel 32 and wheel 33.

Owing to the fact that control lever 35, at least as regards its second arm 37, extends substantially along an edge 50 of plate 22, thus along a corresponding edge 51 of case 2, a moon phase indicator correcting device can be made very simply, in the form of a push-button 52 sliding in the middle part of case 2 and acting, when the user presses it, in the direction of arrow P shown in FIG. 2 against a pin 53 fixed to second arm 37 of the lever. This action has exactly the same effect as that of pin 34, i.e. lever 35 pivots clockwise and causes disc 16 to move forward one step. Consequently, this action does not interfere with the cam mechanism formed by pin 34 and cam surface 49, even when the latter are meshed.

It will be noted that the simple elongated shape of control lever 35, and the arrangement of its two arms and correction means along edge 51 of the watchcase, take up very little place and occupy a lateral space available beside watch movement 5 and moon phase indicator disc 16. In particular, first arm 36 extends substantially between control wheel 33 and the edge of the case, and second arm 37 extends between disc 16 and the edge of the case. Lever 35 constitutes a transmission member that "straddles" the space between the respective locations of the watch movement and the moon phase indicator. This arrangement of the lever also has the advantage of not occupying the space necessary for the power-reserve indicator. It will further be noted that axis 45 of disc 16 is outside the periphery of the watch movement, such that the means for supporting the disc could be placed beside the movement, if necessary.

The elements of the mechanism driving power-reserve indicator hand 18 will be described with reference to FIG. 3, where these elements are shown transparently in order to facilitate reading the drawing. Since the principle of this type of mechanism is well known, it will be described here briefly. It includes a differential gear formed by a planetary gear 56 both of whose inputs are coupled via respective gears to a cover of barrel 57 and to the barrel shaft 58, these two elements being connected by the barrel spring that drives movement 5. The output of planetary gear 56 drives a toothed wheel 59, friction coupled to an auxiliary wheel 60 secured to a finger 61 which can pivot between two stop mechanisms 62, 63 secured to the plate of mechanism 22. Auxiliary wheel 60 meshes on a toothing 64 of a rack 65 pivoting about an axis 66 and secured to a first sector gear 67 centred on axis 66. Sector gear 67 meshes with a second sector gear 68 secured to hand 18 and pivoting about axis 20 thereof. The two stop mechanisms 62 and 63 determine the two end positions of hand 18, corresponding to the maximum and minimum power reserve values of the watch. These two positions also correspond to the two positions of rack 65 shown respectively in continuous and broken lines in FIG. 3.

Rack 65 and sector gears 67 and 68 are mounted between the plate of mechanism 22 and a bridge 70 secured to the plate by screws 71 and 72. It will be noted that the power-reserve indicator drive mechanism occupies a space that is not occupied by the moon phase indicator drive mechanism. This advantageous arrangement also results from the ovoidal shape of the watch and the fact that these indicators are not superposed on watch movement 5. Moreover, since the two additional indicators are outside hour-circle 10, they can be larger than if they had to be inside it.

INDUSTRIAL APPLICABILITY

Although the ovoidal shape of the watch described hereinbefore is particularly advantageous within the scope of the present invention, the latter is not limited to such a shape, but can be applied to any other watch of elongated shape, for example, elliptical, rectangular or barrel-shaped. With this aim in mind, it is also possible to arrange basic watch movement 5 and hour-circle 10 at the centre of the case, for example in order to place two additional indicators respectively in the top part and the bottom part of the dial, to benefit from the advantages described hereinbefore.

What is claimed is:

1. A watch having a case of elongated shape containing an elongated dial, a watch movement, time indicating members associated with an hour-circle on the dial, an additional indicator arranged outside said hour-circle in proximity to one end of the dial, and means for correcting the additional indicator, the additional indicator comprising a toothed disc driven step-by-step by a control lever periodically actuated by the watch movement via a cam mechanism, wherein the additional indicator disc has an external toothing driven by a beak of the control lever, the control lever includes a first arm, which co-operates with the watch movement, a second arm provided with said beak, and a pivoting axis located between the first and second arms, at least the second arm of the control lever extends substantially along one edge of the case, and the correction means include a push-button arranged in said edge of the case and arranged to cause the control lever to pivot by pressing on its second arm.

2. The watch of claim 1, wherein the second arm of the control lever extends between the additional indicator disc and said edge of the case.

3. The watch of claim 1, wherein said cam mechanism includes a cam surface arranged on one side of the first arm of the control lever and a control wheel continuously driven by the watch movement and provided with a pin arranged to push said cam surface against the force of a spring.

4. The watch of claim 3, wherein the first arm of the control lever extends substantially between said control wheel and said edge of the case.

5. The watch of claim 1, wherein the additional indicator is a date or moon phase indicator and appears in an aperture arranged in the dial outside the hour-circle.

6. The watch of claim 1, wherein a rotational axis of the additional indicator disc and the correction means are located outside the periphery of the watch movement.

7. The watch of claim 1, wherein the case and the dial have an ovoidal shape.

8. The watch of claim 7, wherein the watch movement has a substantially circular shape and is housed in the end of the ovoidal case with the largest radius.

9. The watch of claim 1, wherein said watch movement and said hour-circle are concentric.

10. A watch having a case of elongated shape containing an elongated dial, a watch movement, time indicating members associated with an hour-circle on the dial, an additional indicator arranged outside said hour-circle in proximity to one end of the dial and driven by the watch movement via a control mechanism, wherein the case and the dial have an ovoidal shape, having one end of larger radius and one end of smaller radius, the watch movement is substantially circular and arranged in an off-centre position in the direction of the end of larger radius, the additional indicator being arranged in proximity to the other end of the case, and the additional indicator control mechanism includes a control lever extending in proximity to one edge of the case.

11. The watch of claim 10, wherein said control lever is associated with a correction push-button mounted in said edge of the case.

* * * * *